US008900666B2

(12) United States Patent
Liu et al.

(10) Patent No.: US 8,900,666 B2
(45) Date of Patent: Dec. 2, 2014

(54) STABLE NANOPARTICLES FOR ELECTROLESS PLATING

(75) Inventors: Feng Liu, Ashland, MA (US); Maria Anna Rzeznik, Shrewsbury, MA (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 629 days.

(21) Appl. No.: 13/278,865

(22) Filed: Oct. 21, 2011

(65) Prior Publication Data

US 2012/0097548 A1 Apr. 26, 2012

Related U.S. Application Data

(60) Provisional application No. 61/405,491, filed on Oct. 21, 2010.

(51) Int. Cl.

| | |
|---|---|
| ***B05D 3/04*** | (2006.01) |
| ***B05D 3/10*** | (2006.01) |
| ***C25D 5/02*** | (2006.01) |
| ***H05K 3/00*** | (2006.01) |
| ***C23C 18/28*** | (2006.01) |

(52) U.S. Cl.
CPC ..... *C23C 18/28* (2013.01)
USPC ..... 427/304; 205/118; 205/126; 205/184; 427/443.1; 106/1.11

(58) Field of Classification Search
CPC ..... C23C 18/16; C23C 18/42; C23C 18/44; C25D 5/34; C25D 5/54
USPC ..... 205/118, 126, 184; 106/1.05, 1.11, 106/1.15, 1.21, 1.24; 427/443.1, 304
See application file for complete search history.

(56) References Cited

U.S. PATENT DOCUMENTS

| | | | | |
|---|---|---|---|---|
| 4,804,410 | A * | 2/1989 | Haga et al. | 106/1.15 |
| 2004/0115345 | A1* | 6/2004 | Huang et al. | 427/212 |
| 2008/0308001 | A1* | 12/2008 | Okada et al. | 106/1.19 |

FOREIGN PATENT DOCUMENTS

| | | |
|---|---|---|
| JP | S60-36672 | 2/1985 |

OTHER PUBLICATIONS

Chen et al.; "Alkanethiolate-Protected Palladium Nanoparticles"; Chem. Mater. 2000, 12, pp. 540-547.

Ganesan et al.; "Monodisperse Thioether-Stabilized Palladium Nanoparticles: Synthesis, Characterization, and Reactivity"; Chem. Mater. 2007, 19, pp. 3464-3471.

Zabet-Khosousi et al.; "Charge Transport in Nanoparticle Assemblies"; Chem. Rev. 2008, 108, pp. 4072-4124.

Daniel et al.; "Gold Nanoparticles: Assembly, Supramolecular Chemistry, Quantum-Size-Related Properties, and Applications toward Biology, Catalysis, and Nanotechnology"; Chem. Rev. 2004, 104, pp. 293-346.

Cohen et al.; "The Chemistry of Palladium-Tin Colloid Sensitizing Processes"; Journal of Colloid and Interface Science, vol. 55, No. 1, Apr. 1976, pp. 156-162.

Chen et al.; "Chemical preparation of Pd nanoparticles in room temperature ethylene glycol system and its application to electroless copper deposition"; Journal of Colloid and Interface Science, vol. 297, 2006; pp. 143-150.

Lo et al.; "Synthesis of PVP stabilized Cu/Pd nanoparticles with citrate complexing agent and its application as an activator for electroless copper deposition"; Journal of Colloid and Interface Science 310 2007; pp. 190-195.

Lan et al.; "Mechanistic Study of Ag/Pd-PVP Nanoparticles and Their Functions as Catalyst for Electroless Copper Deposition"; Journal of the Electrochemical Society, vol. 155 (4) 2008; pp. K77-K83.

* cited by examiner

*Primary Examiner* — Luan Van
*Assistant Examiner* — Louis Rufo
(74) *Attorney, Agent, or Firm* — John J. Piskorski

(57) ABSTRACT

Stable tin-free palladium catalysts are used to metalize through-holes of printed circuit boards. A stabilizer is included in the catalyst formulation which prevents precipitation and agglomeration of the palladium.

4 Claims, No Drawings

STABLE NANOPARTICLES FOR ELECTROLESS PLATING

This application claims the benefit of priority under 35 U.S.C. §119(e) to U.S. Provisional Application No. 61/405,491, filed Oct. 21, 2010, the entire contents of which application are incorporated herein by reference.

The present invention is directed to stable tin-free nanoparticles for electroless plating of metal. More specifically, the present invention is directed to stable tin-free nanoparticles for electroless plating of metal which provide good adhesion of the metal to a substrate.

Printed circuit boards include laminated non-conductive dielectric substrates that rely on drilled and plated through-holes to form connections between opposite sides or inner-layers of the boards. Electroless plating is well known for preparing metallic coatings on surfaces. Electroless plating of dielectric surfaces require the prior deposition of a catalyst. A common method used to catalyze or activate laminated non-conductive dielectric substrates, prior to electroless plating, is to treat the substrate with an aqueous tin-palladium colloid in an acidic chloride medium. The colloid includes a metallic palladium core surrounded by a stabilizing layer of tin (II) ion complexes, e.g., $SnCl_3^-$, which act as surface stabilizing groups to avoid agglomeration of the colloids in suspension.

In the activation process the palladium-based colloid is adsorbed onto an insulating substrate such as epoxy or polyimide to activate electroless copper deposition. Theoretically, the catalyst particles play roles as carriers in the path of electron transfer from reducing agents to metal ions in the plating bath. Although the performance of electroless copper plating is influenced by many factors, such as composition of the deposition solution and choice of ligand, the activation step is the key factor for controlling the rate and mechanism of electroless deposition. Tin/palladium colloid has been commercially used as activator for electroless metal deposition for decades; however, its sensitivity to air and high cost leave room for improvement.

Although the colloidal tin/palladium catalyst has been used for many years, it has many shortcomings which are becoming more and more pronounced as the quality of manufactured printed circuit boards increase. Along with the reduction in sizes and an increase in performance of electronic devices, the packing density of electronic circuits has become higher and subsequently industry standards for the quality have increased. As a result of greater demands on reliability and in particular due to high and fluctuating cost of palladium, alternative catalyst compositions and the employment of alternative non-precious and less expensive metals is desired. The stability of the colloidal palladium catalyst is also a concern. As mentioned above, the tin/palladium colloid is stabilized by a layer of tin (II) ions. The counterions may prevent palladium from aggregating but the tin (II) ions are readily oxidized to tin (IV), thus the colloid cannot maintain its colloidal structure. This oxidation is promoted by increases in temperature and agitation. If tin (II) is allowed to fall close to zero, then palladium particles grow in size, agglomerate and precipitate and plating stops.

Considerable effort has been made to find new and better catalysts. For example, because of the high cost of palladium, much of the effort has been directed toward the development of a non-noble catalyst, particularly towards the development of a colloidal copper catalyst. There has also been work directed to the development of a tin free palladium catalyst since the stannous chloride used to reduce the palladium is costly and the oxidized tin requires a separate step of acceleration. However, such catalysts have not been shown to be sufficiently active or reliable enough for through-hole plating. Furthermore, these catalysts typically become progressively less active upon standing and the change in activity renders such catalysts unreliable and impractical for commercial use.

Other stabilizing moieties, i.e., replacements for the tin complexes, which have been investigated, include polyvinyl pyrrolidone (PVP) and other polymers. Stable and uniform PVP-protected nanoparticles have been reported by several research groups. PVP plays the role of protective and stabilizing agent. Palladium (II) is known to chemically bind ligands containing nitrogen, sulfur and phosphorus donor atoms. Several groups have reported metal-ligand moieties where the ligand serves as an effective mechanism for anchoring palladium (II) catalysts to substrates. Other metal colloids, such as silver/palladium and copper/palladium have also been reported.

Although there are alternative catalysts for the tin/palladium catalyst, there is still a need for an improved catalyst for use in electroless plating.

In one embodiment a composition includes glutathione and palladium.

In another embodiment methods include: a) providing a substrate with a plurality of through-holes; b) applying a conditioner including one or more cationic surfactants to the through-holes; c) applying a composition including glutathione and palladium to the through-holes; and d) electrolessly depositing a metal on walls of the through-holes.

In a further embodiment methods include: a) providing a substrate with through-holes; b) applying a solvent swell to the through-holes; c) applying an oxidizer to the through-holes; d) applying a neutralizer to the through-holes; e) applying a conditioner including one or more cationic surfactants to the through-holes; f) micro-etching the through-holes; g) applying a composition including glutathione and palladium to the through-holes; and h) depositing a metal on the walls of the through-holes with an electroless metal bath.

The composition including glutathione and palladium forms a stable aqueous solution of nanoparticles which may be used to catalyze electroless metal deposition in the manufacture of electronic components. In addition, the composition enables good adhesion of metal to substrates. The composition is tin free, thus the problems associated with tin (II) ions readily oxidizing to tin (IV) and disrupting the catalyst is avoided. The problem with palladium particles growing in size and agglomerating and precipitating is also inhibited. Since tin is excluded from the composition, the cost of the catalyst is reduced because the costly stannous chloride is no longer required. Further, the acceleration step required when using tin is avoided in preparation of a substrate for metallization, thus a conventional step is eliminated in the preparation of substrates for metallization.

As used throughout this specification, the abbreviations given below have the following meanings, unless the context clearly indicates otherwise: g=gram; mg=milligram; mL=milliliter; L=liter; cm=centimeter; m=meter; mm=millimeter; μm=micron; nm=nanometers; min.=minute; ppm=parts per million; 1 mg/L=1 ppm; ° C.=degrees Centigrade; M=molar; DI=deionized; g/L=grams per liter; s=seconds; wt %=percent by weight; and $T_g$=glass transition temperature.

The terms "printed circuit board" and "printed wiring board" are used interchangeably throughout this specification. The terms "plating" and "deposition" are used interchangeably throughout this specification. All amounts are percent by weight, unless otherwise noted. All numerical ranges are inclusive and combinable in any order except where it is logical that such numerical ranges are constrained to add up to 100%.

Compositions include glutathione and palladium. The glutathione and palladium form an aqueous solution of palladium nanoparticles where the glutathione stabilizes the palladium nanoparticles in the compositions such that the palladium does not substantially agglomerate or precipitate out of the compositions. The average diameter of the nanoparticles is from 1 nm to 20 nm or such as from 2 nm to 5 nm. The glutathione and palladium compositions are free of tin. The composition may be used as a catalyst for electroless deposition of metal.

The compositions may be prepared by combining one or more sources of palladium ions and glutathione in an aqueous solution. One or more reducing agents are included to reduce the palladium (II) ions to their metal state. The components of the solution are agitated to mix the components to form an aqueous solution of stable nanoparticles. Typically, stir bar agitation may be used for small volumes, such as up to 200 mL. Homogenizers may be used for larger volumes. Typical mixing rates may be from 3000 to 25000 rpm. A PowerGen™ 700 by Fischer Scientific is an examples of an apparatus which may be used. Both L and R glutathione as well as a racemic modification of glutathione may be used. Typically L glutathione is used. Glutathione is included in the compositions in amounts of 5 mg/L to 500 mg/L or such as from 50 mg/L to 200 mg/L.

Sources of palladium include water soluble salts of palladium metal. Such salts include, but are not limited to, palladium chloride, palladium sodium chloride, palladium potassium chloride, palladium ammonium chloride, palladium sulfate, palladium nitrate, palladium acetate and palladium oxide. Palladium salts are include in amounts of 50 mg/L to 10 g/L or such as in amounts of 1 g/L to 5 g/L.

Reducing agents include, but are not limited to, compounds such as boron hydride compounds, such as amineboranes, such as dimethylamine borane (DMAB), trimethylamine borane, isopropylamineborane and morpholineborane, sodium borohydride and potassium borohydride, hypophosphorus acid, ammonium, lithium, sodium potassium and calcium salts thereof, formaldehyde, hypophosphites, such as sodium hypophosphite, hydrazine anhydride, carboxylic acids, such as formic acid and ascorbic acid, and reducing sugars, such as glucose, galactose, maltose, lactose, xylose and fructose. Reducing agents are included in the compositions in amounts of 5 mg/L to 500 mg/L or such as in amounts of 20 mg/L to 200 mg/L.

The aqueous compositions have a pH range from 2.5 to 10, or such as from 3 to 5. Buffering agents which may be included in the aqueous compositions include, but are not limited to, carboxylic acids, such as citric acid, tartaric acid, succinic acid, malic acid, malonic acid, maleic acid, lactic acid, acetic acid and salts thereof; amines and salts thereof; and amino acids and salts thereof; and inorganic acids, such as hydrochloric acid, sulfuric acid and nitric acid. Alkaline compounds which may be included to adjust the pH include, but are not limited to, alkali metal hydroxides, such as sodium and potassium hydroxide. The buffering agents are included in amounts sufficient to adjust the pH to the desired range.

The aqueous compositions including glutathione and palladium may be used as catalysts to electrolessly metal plate substrates which include inorganic and organic materials such as glass, ceramics, porcelain, resins, paper, cloth and combinations thereof. Substrates also include metal-clad and unclad materials, such as printed circuit boards. Such printed circuit boards include metal-clad and unclad substrates with thermosetting resins, thermoplastic resins and combinations thereof, including fibers, such as fiberglass, and impregnated embodiments of the foregoing. Since the aqueous compositions are free of tin, the conventional step of using an accelerator prior to applying the composition to the substrate is excluded, thus reducing the number of steps in the overall metallization process. The concentration of the palladium nanoparticles ranges from 15 ppm to 1000 ppm or such as from 25 ppm to 50 ppm in the composition. The temperatures and time periods for the method steps for metallization of the substrates are conventional and are well known in the art.

Thermoplastic resins include, but are not limited to, acetal resins, acrylics, such as methyl acrylate, cellulosic resins, such as ethyl acetate, cellulose propionate, cellulose acetate butyrate and cellulose nitrate, polyethers, nylon, polyethylene, polystyrene, styrene blends, such as acrylonitrile styrene and copolymers and acrylonitrile-butadiene styrene copolymers, polycarbonates, polychlorotrifluoroethylene, and vinylpolymers and copolymers, such as vinyl acetate, vinyl alcohol, vinyl butyral, vinyl chloride, vinyl chloride-acetate copolymer, vinylidene chloride and vinyl formal.

Thermosetting resins include, but are not limited to, allyl phthalate, furane, melamine-formaldehyde, phenol-formaldehyde and phenol-furfural copolymers, alone or compounded with butadiene acrylonitrile copolymers or acrylonitrile-butadiene-styrene copolymers, polyacrylic esters, silicones, urea formaldehydes, epoxy resins, allyl resins, glyceryl phthalates and polyesters.

The aqueous glutathione and palladium compositions may be used to catalyze both low and high $T_g$ resins. Low $T_g$ resins have a $T_g$ below 160° C. and high $T_g$ resins have a $T_g$ of 160° C. and above. Typically high $T_g$ resins have a $T_g$ of 160° C. to 280° C. or such as from 170° C. to 240° C. High $T_g$ polymer resins include, but are not limited to, polytetrafluoroethylene (PTFE) and polytetrafluoroethylene blends. Such blends include, for example, PTFE with polypheneylene oxides and cyanate esters. Other classes of polymer resins which include resins with a high $T_g$ include, but are not limited to, epoxy resins, such as difunctional and multifunctional epoxy resins, bimaleimide/triazine and epoxy resins (BT epoxy), epoxy/polyphenylene oxide resins, acrylonitrile butadienestyrene, polycarbonates (PC), polyphenylene oxides (PPO), polypheneylene ethers (PPE), polyphenylene sulfides (PPS), polysulfones (PS), polyamides, polyesters such as polyethyleneterephthalate (PET) and polybutyleneterephthalate (PBT), polyetherketones (PEEK), liquid crystal polymers, polyurethanes, polyetherimides, epoxies and composites thereof.

In one embodiment the aqueous glutathione and palladium compositions may be used to deposit metal on the walls of through-holes. The aqueous glutathione and palladium compositions may be used in both horizontal and vertical processes of manufacturing printed circuit boards.

Through-holes are formed in the board by drilling or punching or any other method known in the art. After the formation of the through-holes, the boards are optionally rinsed with water and a conventional organic solution is used to clean and degrease the board followed by desmearing the through-hole walls. Typically desmearing of the through-holes begins with application of a solvent swell.

Conventional solvent swells may be used to desmear the through-holes. Such solvent swells, include but are not limited to, glycol ethers and their associated ether acetates. Conventional amounts of glycol ethers and their associated ether acetates may be used. Such solvent swells are well known in the art. Commercially available solvent swells include, but are not limited to, CIRCUPOSIT CONDITIONER™ 3302, CIRCUPOSIT HOLE PREP™ 3303 and CIRCUPOSIT HOLE PREP™ 4120 (commercially available from Rohm and Haas Electronic Materials, Marlborough, Mass.).

Optionally, the through-holes are rinsed with water. An oxidizer is then applied to the through-holes. Such oxidizers include, but are not limited to, sulfuric acid, chromic acid, alkaline permanganate or by plasma etching. Typically alkaline permanganate is used as the oxidizer. An example of a commercially available oxidizer is CIRCUPOSIT PROMOTER™ 4130 commercially available from Rohm and Haas Electronic Materials, Marlborough, Mass.

Optionally, the through-holes are rinsed again with water. A neutralizer is then applied to the through-holes to neutralize any acid residues or basic residues left by the oxidizer. Conventional neutralizers may be used. Typically the neutralizer is an aqueous alkaline solution containing one or more amines or a solution of 3 wt % peroxide and 3 wt % sulfuric acid. Optionally, the through-holes are rinsed with water and the printed circuit boards are dried.

After neutralizing an alkaline conditioner is applied to the through-holes. Such alkaline conditioners include, but are not limited to, aqueous alkaline surfactant solutions containing one or more quaternary amines and polyamines and one or more cationic surfactants. In addition, pH adjusters or buffers, non-ionic surfactants, anionic surfactants and amphoteric surfactants also may be included in the conditioners. Typically the cationic surfactants are combined with the non-ionic surfactants. Surfactants may be included in the conditioners in amounts of 0.05 wt % to 5 wt %, or such as from 0.25 wt % to 1 wt %. Commercially available alkaline conditioners include, but are not limited to, CIRCUPOSIT CONDITIONER™ 231, 813 and 860 available from Rohm and Haas Electronic Materials. Optionally, the through-holes are rinsed with water after conditioning.

Cationic surfactants include, but are not limited to, tetraalkylammonium halides, alkylrimethylammonium halides, hydroxyethyl alkyl imidazoline, alkylbenzalkonium halides, alkylamine acetates, alkylamine oleates and alkylaminoethyl glycine.

Non-ionic surfactants include, but are not limited to, aliphatic alcohols such as alcohol alkoxylates. Such aliphatic alcohols have ethylene oxide, propylene oxide, or combinations thereof, to produce a compound having a polyoxyethylene or polyoxypropylene chain within the molecule, i.e., a chain composed of recurring ($—O—CH_2—CH_2—$) groups, or a chain composed of recurring ($—O—CH_2—CH—CH_3$) groups, or combinations thereof. Typically such alcohol alkoxylates are alcohol ethoxylates having carbon chains of 7 to 15 carbons, linear or branched, and 4 to 20 moles of ethoxylate, typically 5 to 40 moles of ethoxylate and more typically 5 to 15 moles of ethoxylate.

Many of such alcohol alkoxylates are commercially available. Examples of commercially available alcohol alkoxylates are linear primary alcohol ethoxylates such as NEODOL 91-6, NEODOL 91-8 and NEODOL 91-9 ($C_9$-$C_{11}$ alcohols having an average of 6 to 9 moles of ethylene oxide per mole of linear alcohol ethoxylate) and NEODOL 1-73B ($C_{11}$ alcohol with an average blend of 7 moles of ethylene oxide per mole of linear primary alcohol ethoxylate). Both are commercially available from Shell Oil Company, Houston, Tex.

Anionic surfactants include, but are not limited to, alkylbenzenesulfonates, alkyl or alkoxy napthalenesulfonates, alkyldiphenyl ether sulfonates, alkyl ether sulfonates, alkylsulfuric esters, polyoxyethylene alkyl ether sulfuric esters, polyoxyethylene alkyl phenol ether sulfuric esters, higher alcohol phosphoric monoesters, polyoxyalkylene alkyl ether phosphoric acids (phosphates) and alkyl sulfosuccinates Amphoteric surfactants include, but are not limited to, 2-alkyl-N-carboxymethyl or ethyl-N-hydroxyethyl or methyl imidazolium betaines, 2-alkyl-N-carboxymethyl or ethyl-N-carboxymethyloxyethyl imidazolium betaines, dimethylalkyl betaines, N-alkyl-β-aminopropionic acids or salts thereof and fatty acid amidopropyl dimethylaminoacetic acid betaines.

Conditioning is followed by micro-etching the through-holes. Conventional micro-etching compositions may be used. Micro-etching provides a micro-roughened copper surface on exposed copper (e.g. innerlayers and surface etch) to enhance subsequent adhesion of deposited electroless and electroplate. Micro-etches include, but are not limited to, 60 g/L to 120 g/L sodium persulfate or sodium or potassium oxymonopersulfate and sulfuric acid (2%) mixture, or generic sulfuric acid/hydrogen peroxide. An example of a commercially available micro-etching composition is CIRCUPOSIT MICROETCH™ 3330 available from Rohm and Haas Electronic Materials. Optionally, the through-holes are rinsed with water.

Optionally, a pre-dip is then applied to the micro-etched through-holes. Examples of pre-dips include 2% to 5% hydrochloric acid or an acidic solution of 25 g/L to 75 g/L sodium chloride. Optionally, the through-holes are rinsed with cold water.

An aqueous composition including glutathione and palladium metal nanoparticles is then applied to the through-holes to function as a catalyst for electroless metal deposition. The pH ranges from 2.5 to 10. The aqueous composition is applied to the through-holes at temperatures from room temperature to 50° C., typically from room temperature to 40° C. The through-holes optionally may be rinsed with water after application of the catalyst.

The walls of the through-holes are then electrolessly plated with a metal using an electroless metal plating bath. Conventional electroless baths including immersion baths may be used. Such baths are well known in the art and in the literature. Typically the printed wiring board is placed in an electroless or immersion bath containing the metal ions of the desired metal to be deposited on the walls of the through-holes. Metals which may be deposited on the walls of the through-holes include, but are not limited to, copper, nickel, gold, silver and copper/nickel alloys. A layer of gold or silver finish using immersion gold or silver may also be deposited over a copper, copper/nickel or nickel deposit on the walls of the through-holes. Typically, copper, gold and silver are deposited on the walls of the through-holes, more typically copper is deposited on the walls of the through-holes.

After the metal is deposited on the walls of the through-holes, the through-holes are optionally rinsed with water. Optionally, anti-tarnish compositions may be applied to the metal deposited on the walls of the through-holes. Conventional anti-tarnish compositions may be used. Examples of anti-tarnish compositions are ANTI TARNISH™ 7130 and CUPRATEC™ 3 (commercially available from Rohm and Haas Electronic Materials). The through-holes may optionally be rinsed by a hot water rinse and then the boards may be dried.

After the through-holes are metal plated with the electroless or immersion metal baths, the substrates may undergo further processing. Further processing may include conventional processing by photoimaging and further metal deposition on the substrates such as electrolytic metal deposition of, for example, copper, copper alloys, tin and tin alloys. Conventional electrolytic metal baths may be used. Such baths are well known in the art and in the literature.

The composition including glutathione and palladium forms a stable aqueous solution of palladium nanoparticles which may be used to catalyze electroless metal deposition in the manufacture of electronic components. In addition, the composition enables good adhesion of metal to substrates. The composition is tin free, thus the problems associated with tin (II) ions readily oxidizing to tin (IV) and disrupting the catalyst is avoided. The problem with palladium particles growing in size and agglomerating and precipitating is also inhibited. Since tin is excluded from the composition, the cost of the catalyst is reduced because the costly stannous chloride is no longer required. Further, the acceleration step required when using tin is avoided in preparation of a substrate for metallization, thus a conventional step is eliminated in the preparation of substrates for metallization.

The following examples are included to further illustrate the invention but are not intended to limit the scope of the invention.

EXAMPLE 1

Comparative

All chemical compounds used in this example were reagent grade unless designated otherwise. The chemical compounds were obtained from Aldrich Chemical Company, Inc. (Milwaukee, Wis.) or Fisher Scientific, Inc. unless designated otherwise. A stock solution of L-glutathione and palladium aqueous solution was prepared by adding 14 mg/L L-glutathione to a beaker containing 35 mL of DI water at room temperature. 66 mg sodium palladium chloride in 3 mL of DI water was added to the beaker containing the L-glutathione with stirring and then the mixture was strongly agitated using a stir bar. 68 mg sodium borohydride in 2 mL of water was added to the mixture with additional strong agitation. The solution turned a black color indicating reduction of palladium ions to palladium metal. The pH of the aqueous solution of L-glutathione and palladium metal nanoparticles was measured using an Accumet™ AB 15 pH meter from Fisher Scientific. The pH of the aqueous solution ranged from 8 to 9.3 g/L of sodium citrate was added to the aqueous solution and the pH was adjusted to 4 with 0.1M hydrochloric acid. The concentration of the palladium nanoparticles was 25 ppm. The average diameter of the nanoparticles was determined to be 2.5 nm±0.9 nm. A transmission electron microscope was used to measure the diameters of the nanoparticles. The solution of nanoparticles was stable. There was no indication of any precipitation or aggregation of nanoparticles.

Two each of 370T epoxy/glass, FR406 epoxy/glass, NELCO-6 epoxy/glass, NP-175 epoxy/glass, SY1000-2 epoxy/glass and TU752 epoxy/glass laminate boards were obtained from Tech Circuits, Wellingford, Conn. All the boards were copper-clad. Multiple through-holes were drilled in each of the boards. The average diameter of the through-holes was 1 mm The through-holes of each board were then desmeared, prepped for electroless copper plating and electrolessly plated with copper in a vertical process as follows:

1. Each board was treated with 240 liters of solvent swell for 7 min. at 80° C. The solvent swell was an aqueous solution containing 10% diethylene glycol mono butyl ether, and 35 g/L of sodium hydroxide.
2. The boards were then rinsed with cold tap water for 4 min. at room temperature.
3. The through-holes in each board were then treated with 550 liters of an alkaline oxidizing agent of 50-60 g/L aqueous alkaline permanganate at a pH of 12 for 10 min. at 80° C.
4. The boards were rinsed with cold tap water for 4 min. at room temperature.
5. The though-holes in the boards were then treated with 180 liters of an aqueous neutralizer composed of 3 wt % hydrogen peroxide and 3 wt % sulfuric acid at 50° C. for 5 min.
6. The boards were then rinsed with cold tap water for 4 min.
7. Each board was then treated with CONDITIONER™ 860 alkaline conditioner which included a cationic surfactant and buffer system to maintain a pH of around 11. The alkaline conditioners are commercially available from Rohm and Haas Electronic Materials, LLC (Marlborough, Mass.).
8. Each board was then rinsed with cold tap water for 4 min. at room temperature.
9. The through-holes of each board were then micro-etched with 100 liters of an aqueous alkaline solution of 20 g/L ammonium persulfate for 2 min. at room temperature.
10. The boards were then rinsed with cold tap water for 4 min. at room temperature.
11. A pre-dip of 5% concentrated hydrochloric acid was then applied to the through-holes for 1 min. at room temperature.
12. The boards were then rinsed with cold tap water for 1 min. at room temperature.
13. Half of the boards had their through-holes primed for electroless copper plating with 2 liters of the L-glutathione and palladium catalyst described above for 5 min. at 40° C. The concentration of the palladium nanoparticles was 25 ppm. The pH of the catalyst was 4. The other half of the boards were primed with 2 liters of a control tin/palladium catalyst with a palladium particle concentration of 25 ppm for 5 min. at 40° C. The stock solution had the formulation in Table 1 below.

TABLE 1

| COMPONENT | AMOUNT |
|---|---|
| Palladium Chloride | 1 g |
| Concentrated Hydrochloric Acid | 300 ml |
| Sodium Stannate | 1.5 g |
| Tin chloride | 40 g |
| Water | To one liter |

14. The boards were then rinsed with cold tap water for 2.5 min at room temperature.
15. The walls of the through-holes of the boards were then plated with electroless copper for 15 minutes at 36° C. The electroless copper bath had the following formulation:

TABLE 2

| COMPONENT | AMOUNT |
|---|---|
| Copper sulfate Pentahydrate | 2 g |
| Formaldehyde | 2.5 g |
| Sodium hydroxide | 5 g |
| Ethylene diamine tetraacetate (EDTA) | 25 g |
| Chloride ions | 5 g |
| 2,2-Dipyridyl | 2 ppm |
| Water | To one liter |

16. After electroless copper deposition the boards were rinsed with cold tap water for 4 min. at room temperature.
17. Each board was sectioned laterally to expose the copper plated walls of the through-holes. Multiple lateral sections 1 mm thick were taken from the walls of the sectioned through-holes of each board to determine the through-hole wall coverage for the boards using the European Backlight Grading Scale.

1 mm sections from each board were placed under an Olympus GX71 optical microscope of 50× magnification. The quality of the copper deposit was determined by the amount of light that was observed under the microscope. If no light was observed the section was completely black and covered with a copper deposit and was rated a 5 on the backlight scale. If light passed through the entire section without any dark areas, this indicated very little to no copper metal deposition on the wall and the section was rated 0. If sections had some dark regions as well as light regions, they were rated between 0 and 5.

The holes and gaps were manually counted for each section, tallied and averaged for each board. The table below shows the results of the sections taken from each of the boards.

TABLE 3

| Catalyst | Laminate 370T | Laminate FR406 | Laminate NELCO-6 | Laminate NP-175 | Laminate SY1000-2 | Laminate TU752 |
|---|---|---|---|---|---|---|
| L-glutathione/Pd | 4.81 | 4.50 | 4.60 | 4.90 | 4.75 | 4.99 |
| Sn/Pd | 4.42 | 4.20 | 4.11 | 4.70 | 4.30 | 4.80 |

The backlight results showed that the L-glutathione/palladium catalyst had better copper coverage for each laminate in contrast to the tin/palladium (Sn/Pd) catalyst. Only two laminates electrolessly plated with copper using the Sn/Pd catalyst had backlight values of greater than 4.5. All of the laminates electrolessly copper plated using the L-glutathione/palladium catalyst had backlight values of 4.5 and greater.

EXAMPLE 2

Adhesion Test 370T epoxy/glass, FR406 epoxy/glass, NELCO-6 epoxy/glass, NP-175 epoxy/glass, SY1000-2 epoxy/glass and TU752 epoxy/glass laminate boards with a plurality of through-holes with an average diameter of 1 mm were desmeared, prepped for electroless copper plating and electrolessly plated with copper in a vertical process as follows:

1. Each board was treated with 240 liters of solvent swell for 7 min. at 80° C. The solvent swell was an aqueous solution containing 10% diethylene glycol mono butyl ether, and 35 g/L of sodium hydroxide.
2. The boards were then rinsed with cold tap water for 4 min. at room temperature.
3. The through-holes in each board were then treated with 550 liters of an alkaline oxidizing agent of 50-60 g/L aqueous alkaline permanganate at a pH of 12 for 10 min. at 80° C.
4. The boards were rinsed with cold tap water for 4 min. at room temperature.
5. The though-holes in the boards were then treated with 180 liters of an aqueous neutralizer composed of 3 wt % hydrogen peroxide and 3 wt % sulfuric acid at room temperature for 4 min.
6. The boards were then rinsed with cold tap water for 4 min.
7. Each board was then treated with CONDITIONER™ 860 alkaline conditioner which included a cationic surfactant and buffer system to maintain a pH of around 11.
8. Each board was then rinsed with cold tap water for 4 min. at room temperature.
9. The through-holes of each board were then micro-etched with 100 liters of an aqueous alkaline solution of 20 g/L ammonium persulfate for 2 min. at room temperature.
10. The boards were then rinsed with cold tap water for 4 min. at room temperature.
11. A pre-dip of 5% concentrated hydrochloric acid was then applied to the through-holes for 1 min. at room temperature.
12. The boards were then rinsed with cold tap water for 1 min. at room temperature.
13. 2 liters of the L-glutathione/palladium catalyst described in Example 1 was applied to the through-holes for 5 min. at 40° C.
14. The boards were then rinsed with cold tap water for 2.5 min. at room temperature.
15. The walls of the through-holes of the boards were then plated with electroless copper for 15 minutes at 36° C. The electroless copper bath had the same formulation as in Example 1.
16. After electroless copper deposition the boards were rinsed with cold tap water for 4 min. at room temperature. They were then air dried.
17. A tape test was performed on the adhesion of the copper deposit for each board. The test was performed by applying 3M Scotch tape to the copper layer deposited at the surface of each through-hole and pulling the tape from the deposit. There was no observable copper residue on any of the tape samples after removing them from the copper layers. Accordingly, all of the copper electrolessly plated had good adhesion.

What is claimed is:

1. A method comprising:

a) providing a substrate with a plurality of through-holes;
b) applying a conditioner comprising one or more cationic surfactants to the through-holes;
c) applying a composition comprising glutathione and palladium to the through-holes; and
d) depositing a metal on walls of the through-holes with an electroless metal bath.

2. The method of claim 1, wherein the composition has a pH range of 2.5 to 10.

3. The method of claim 1, further comprising a step of electrolytically depositing a second metal adjoining the metal on the walls of the through-holes.

4. A method comprises:

a) providing a substrate with through-holes;
b) applying a solvent swell to the through-holes;
c) applying an oxidizing agent to the through-holes;
d) applying a neutralizer to the through-holes;
e) applying a conditioner comprising one or more cationic surfactants to the through-holes;
f) micro-etching the through-holes;
g) applying a composition comprising glutathione and palladium to the through-holes; and
h) depositing a metal on walls of the through-holes with an electroless metal bath.

* * * * *